US006299343B1

(12) United States Patent
Pekerman

(10) Patent No.: US 6,299,343 B1
(45) Date of Patent: Oct. 9, 2001

(54) METHOD OF HEATING AND/OR HOMOGENIZING OF LIQUID PRODUCTS IN A STEAM-LIQUID INJECTOR

(75) Inventor: Oleg Pekerman, Bnei Aish (IL)

(73) Assignee: Tivon Co., Tivon (IL)

( * ) Notice: Subject to any disclaimer, the term of this patent is extended or adjusted under 35 U.S.C. 154(b) by 0 days.

(21) Appl. No.: 09/555,601

(22) PCT Filed: Nov. 29, 1998

(86) PCT No.: PCT/IL98/00581

§ 371 Date: May 31, 2000

§ 102(e) Date: May 31, 2000

(87) PCT Pub. No.: WO99/28022

PCT Pub. Date: Jun. 10, 1999

(30) Foreign Application Priority Data

Dec. 2, 1997 (IL) ..... 122396

(51) Int. Cl.[7] ..... B01F 15/02

(52) U.S. Cl. ..... 366/163.2; 137/3; 366/144; 366/172.1; 366/177.1

(58) Field of Search ..... 366/163.1, 163.2, 366/167.1, 172.1, 191, 348, 349, 150.1, 177.1, 144; 417/182, 185–189, 193, 192; 137/3, 888, 889, 606; 426/519, 521, 522

(56) References Cited

U.S. PATENT DOCUMENTS 344,480 * 6/1886 Holden et al. ..... 417/193
414,098 * 10/1889 Westphal ..... 417/193
3,200,764 * 8/1965 Saunder, Jr. ..... 417/185
3,799,195 * 3/1974 Hermans ..... 366/163.1
3,891,353 * 6/1975 Templeman ..... 417/185
4,586,873 * 5/1986 Lepretre et al. ..... 417/185
4,634,559 * 1/1987 Eckert ..... 137/3
5,205,648 4/1993 Fissenko ..... 366/177
5,275,486 1/1994 Fissenko ..... 366/177
5,338,113 * 8/1994 Fissenko ..... 137/889
5,544,961 8/1996 Fuks et al. ..... 366/163.2
5,863,587 * 1/1999 Badertscher et al. ..... 426/519

* cited by examiner

*Primary Examiner*—Tony G. Soohoo
(74) *Attorney, Agent, or Firm*—Blank Rome Comisky & McCauley LLP

(57) ABSTRACT

A method of heating and/or homogenizing of various liquid food products by means of a steam-liquid injector (1) is disclosed. The method complies feeding of steam and a liquid product into a mixing chamber (3) through corresponding nozzles (2, 4) and then accelerating the flow of the product to a maximum speed depending on particular processing operating parameters. The acceleration is carried out without exceeding the speed at which the static pressure of the flow matches the saturation pressure of the product at the input temperature. The steam and liquid product are mixed within the mixing chamber (3) and then compressed to obtain condensation of steam within the product.

12 Claims, 2 Drawing Sheets

Figure 1:
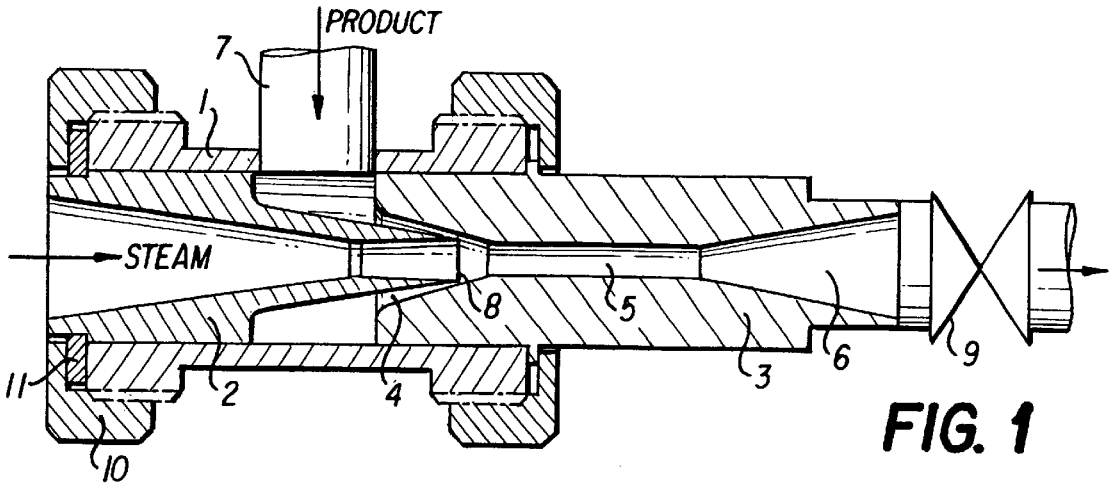

METHOD OF HEATING AND/OR HOMOGENIZING OF LIQUID PRODUCTS IN A STEAM-LIQUID INJECTOR

CROSS REFERENCE TO RELATED APPLICATION

This is a National Phase Application of PCT Application No. PCT/IL98/00581 which in turn is based on Israeli Application No. 122396 filed Nov. 29, 1998, the priority of which is claimed herein.

BACKGROUND OF THE INVENTION

This invention relates to methods of heating and/or homogenizing of liquid products in a steam-liquid injector. By liquid products (hereinafter: products) are meant liquids with different degrees of viscosity, with or without solid particles (solid phase) dispersed in them. By a steam-liquid injector is meant an injector which uses steam as a process medium and liquid as injected medium.

The prior art methods of heating and/or homogenizing of products in a steam-liquid injector include the following steps:

feeding steam and a product into a mixing chamber—through a steam nozzle and a product nozzle accordingly;

forming in the mixing chamber a two-phase steam-liquid flow by mixing the product with steam;

compressing the two-phase steam-liquid flow and condensing steam in the product.

Examples of the use of this method and devices based thereon can be found in the following patents:

[1] WO 89/10184, also published as EP 0399041, describes an emulsifier based on a passive steam-liquid injector;

[2] SU 1472052 describes a method of liquid foodstuff heating in a steam-liquid injector;

[3] SU 1281761 describes a water-heating steam-liquid injector.

[4] SU 1507299 describes a pasteurization method for a liquid whole milk substitute in a passive supersonic steam-liquid injector,

[5] U.S. Pat. No. 5,205,648 and [6] U.S. Pat. No. 5,275,486 <<Method and Device for Acting upon Fluids by Means of a Shock Wave>> describe, as an instance of application, heating and homogenizing of liquid foodstuffs in a steam-liquid injector, wherein product and steam are fed to the mixing chamber at a subsonic speed, creating a two-phase steam-liquid mixture; in the process the mixture is first sped up to the sonic and then to a supersonic speed and, due to a shock wave, transformed into a single-phase liquid flow traveling at a subsonic speed.

[7] U.S. Pat. No. 5,544,961 <<Two-Phase Supersonic Flow System>> describes, as an instance of application, heating and homogenizing of liquid foodstuffs in a steam-liquid injector, with product fed to the mixing chamber at a subsonic speed and steam fed at a supersonic speed, creating a two-phase steam-liquid mixture traveling at a supersonic speed; in the process the two-phase steam-liquid flow, due to a shock wave, is transformed into a single-phase liquid flow traveling at a subsonic speed.

[7] U.S. Pat. No. 5,544,961 <<Two-Phase Supersonic Flow System>> describes, as an instance of application, heating and homogenizing of liquid foodstuffs in a steam-liquid injector, with product fed to the mixing chamber at a subsonic speed and steam fed at a supersonic speed, creating two-phase steam-liquid mixture traveling at a supersonic speed; in the process the two-phase steam-liquid flow, due to a shock wave, is transformed into a single-phase liquid flow traveling at a subsonic speed.

Some distinctive features of the method and device suggested by the above patent provide for a more stable operation of the injector, a higher shock wave and a higher degree of sterility and homogeneity of the product.

From the points of the essence of the present invention, the number of common features and the objects in view, its closest prototype is the method and device described in an article [8] under the title <<The Principle and the Use of a New Multifunction Direct Steam Technology (Ultrasonic Device) in Food and Dairy Industry>> by M. Rogenhofer, E. Hauss and V. Fissenko, published in <<Magazine for Food and Dairy Industry>> # 13/114, Mar. 25, 1993).

[8] [M. Rogenhofer, E. Hauss, V. Fisenko <<Aufbau und Wizkungsweise einer neuen multifunktionalen Uberschall-Direktdampf-Technologie (Transsonic-Gerat) fur den Milch-und-Lebensmittelbereich>>].

According to the authors of the above article, the injector described in their article was based on U.S. Pat. No. 5,205,648 [5] and U.S. Pat. No. 5,275,486 [6].

Based on testing operating conditions given in the article, it can be presumed that under some regimes (according to steam pressures forward of the injector and inside the mixing chamber) the steam was fed to the mixing chamber at a supersonic speed. In other words, in such cases the injector operated according to U.S. Pat No. 5,544,961 [7]. This enables us to consider the results according to several patents simultaneously.

The test data reported in the above article demonstrate that the required homogenizing standards have not been achieved whereas the pasteurization quality corresponds to that achieved on conventional equipment at an appropriate temperature. From FIG. 5 and information contained in the article [8], it can be seen that the stability of the injector's operation decreases sharply with the increase in the injection index, i.e. with reduction of the product's temperature difference between the inlet and the outlet of the injector. In all the above analogs and prototypes all the essential features, both of methods and devices, are related to conditions of steam feeding to the mixing chamber, proportions between the dimensions of the steam nozzle channel and the mixing chamber, and the effect of these parameters on the injector's operation. The device's longitudinal section given in FIG. 2. in the article.[8] and description of its operation demonstrate that the product nozzle's critical section area is sufficiently large to allow a relatively low speed of product at the point where it is mixed with The steam. The fact that the device works as a passive injector suggests a low speed of product. Likewise, in other designs or design and calculation instructions for injectors no importance is attached to the flow speed in the mixing area. For instance: [9] Y.Y. Sokolov and N. M. Zinger, <<Stream Devices>>, Moscow, <<Energhia>>, 1970, pp. 234–251.

The stability of the injector's operation, especially at the moment of start and in transient condition, remains one of the main problems of the prior art injector systems.

Accordingly, they require highly skilled maintenance staff especially start up men. As a result, the injectors are perceived as unreliable and unpredictable devices which restricts their application despite their many advantages

OBJECTS AND SUMMARY OF THE INVENTION

The aim of the present invention is to improve the quality of products processed by the injector Quality attribute of foodstuffs and pharmaceutical products, for instance, are sterility, homogeneity, reduced thermal melting of proteins, conservation of vitamins, biological activity, etc. The other aims of the present invention include: increasing the stability of the injector's operation, increasing its injection index and regulating the intensity of the shock wave.

The stated aim can be achieved by the following method:

steam and liquid product are fed into the mixing chamber of the injector through a steam nozzle and a product nozzle correspondingly, in said chamber, two-phase steam-liquid flow is formed by mixing the product with steam; this flow is subjected to compression causing condensation of the steam in the product; the product is accelerated at entry to the mixing chamber to a maximum permissible speed matching processing operating conditions while not exceeding the speed at which the static pressure of the flow matches the saturation pressure at an input temperature of the product, the maximum speed, according to the liquid flow speed curve in the injector channel before steam feeding, being observed at the output cross-sectional area of the product nozzle.

The above operation sequence relates to the general case. The preferred options of embodiment of the suggested method are as follows:

steam is fed to the mixing chamber at the sonic or a supersonic speed;

steam is fed to the mixing chamber with temperature equal to or lower than final product heating temperature, but remaining above the input temperature of the product. The preferred temperature is calculated by the following formula:

$$Tst = Tin + \frac{Tout - Tin}{2},$$

where Tst is steam temperature at the mixing chamber inlet Tin is product temperature at the injector inlet Tout final product heating temperature;

transmission of the two-phase steam-liquid flow formed in the mixing chamber at a speed equal or exceeding the local sonic speed;

subjection of said flow to shock wave, compression jump, condensation jump (later on - to shock wave);

creation at the injector outlet of regulated backpressure, thereby enabling regulation of intensity of the shock wave and its location in the channel of the injector;

partial heat and/or mass abstraction from the supersonic steam-liquid flow;

feeding the product to the mixing chamber in the form of a thin sheet with thickness within 0.15–2.5 mm;

feeding steam to the mixing chamber only on one side of said sheet of product;

feeding steam to the mixing chamber on both sides of said sheet of product;

feeding the product through product nozzle placed along the injector axis, whereas steam is fed through steam nozzle placed concentrically to the product nozzle.

DETAILED DESCRIPTION OF PREFERRED EMBODIMENTS

The main distinctive feature of the method of the invention is the increase in speed of product fed to the mixing chamber, namely:

the product is accelerated at entry to a maximum permissible speed matching processing operating conditions while not exceeding the speed at which the static pressure of the flow matches the saturation pressure at an input temperature of the product, the maximum speed, according to the liquid flow speed curve in the injector channel before steam feeding, being observed at the output cross-sectional area of the product nozzle.

These features, separately and in the aggregate, provide for new good properties listed below.

Firstly, a new injector has been created, based on a new conception which includes methods of operation of two prior art injectors: steam-liquid injector which uses steam as a process medium and liquid as injected medium (See [9] pp.); steam-liquid injector which uses liquid as a process medium and steam as injected medium (See [9] pp ). The new method of injector operation combines advantages of steam-liquid injectors (good operating characteristic, especially of those with supersonic steam flow and two-phase steam-liquid mixtures) and liquid-steam injectors (easy to handle, reliable start stable performance). In addition, the new injector based on the new method is free from imperfections of both of the above types of injectors.

Secondly, increase in product flow speed at entry to the mixing chamber while retaining the same flow rate of the product, will reduce the thickness of the product sheet contacting with steam, Thus improving heat- and mass interchange. As a result, Reynolds number (Re) increases, leading to increase in turbulization of the flow and higher probability of the full contact between product mass and steam. This, in its turn, insures forming of a more homogeneous and finer dispersed two-phase steam-liquid flow, thereby improving the injector performance. Thirdly, kinetic energy of the flow after mixing increases as square speed of the flow fed to the mixing chamber (according to formulas 1-6 on p. 14 [9]). This leads to reduction of the shock loss at the time of mixing and increases the injector's coefficient of efficiency. (See formulas: 1-7, 1-8, 1-9, 1-10 and 1-11 on p. 14 [9]). As a result, the stability of the injector's operation, its operating characteristic and homogeneity of the product improve.

Fourthly, when the product flow at the mixing chamber nozzle reaches a speed at which the static pressure of the flow nearly matches the saturation pressure at the input temperature of the product, it becomes possible to substantially increase the injection index (U) - up to and over 100. This becomes possible because even slight heating of a product (for instance, by 4–7° C.), as a result of energy impulse exchange between steam and product, makes the mixing chamber pressure equal to or slightly below that of the saturation (cavitation) pressure. As a result, condensation of the working steam ceases, and steam fed to the mixing chamber serves to form a two-phase steam-liquid flow. This allows a significant speed gradient between the product and steam, without steam condensing along a large part of the mixing chamber, thereby providing better dispersion and homogenizing of the product. This, in its turn, insures forming of a more homogeneous and finer dispersed two-phase steam-liquid flow which reflects on the injector's operating characteristics. In addition,.according to [9] (p.14), as the injection index (U) increases, so does the injector's coefficient of efficiency.

Fifthly, the product flow speed at the mixing chamber nozzle does not exceed the speed at which static pressure of the flow matches the saturation pressure at the input temperature of the product. Exceeding this speed would increase power consumption, causing deterioration of operating conditions and in some cases disabling the injector.

Six. The fact that the maximum speed, according to the liquid flow speed curve in the injector channel steam feeding, is observed at the output cross-sectional area of the product nozzle makes it easier to start the injector and insures its stable operation.

The first preferred option of embodiment of the suggested method involves feeding of steam to the mixing chamber at the sonic or a supersonic speed which ensures a number of advantages.

Speed gradient between the product and steam increases, thereby improving homogeneity of the product. In addition, according to Weber formula, the higher speed of steam, the finer is breaking of liquid drops in the steam flow. This also leads to forming of a more homogeneous and finer dispersed two-phase steam-liquid flow improving the injector performance and, consequently, to a decrease in sonic speed in this particular medium which, in its turn, (as will be demonstrated below) increases the intensity of shock wave. As experiments have demonstrated, the features listed above increase the stability of the injector's operation as compared with the prior art models and improve homogeneity of the product. As steam pressure at the injector input grows, so do the above parameters.

The second preferred option of embodiment of the method of the invention involves feeding of steam to the mixing chamber with temperatures equal to or lower than final product heating temperature, but remaining above input temperature of the product. The preferred temperature is calculated by the following formula:

$$Tst = Tin + \frac{Tout - Tin}{2},$$

where Tst is steam temperature at the mixing chamber inlet Tin is product temperature at the injector inlet Tout final product heating temperature. This reduces the <<burning-in>> of the product and thermal melting of proteins, conserves vitamins and biological activity of the substance and retains natural color, smell and taste of the product Depression of Tst below Tin is not only inadvisable but hazardous as well, because due to the absence of condensation, pressure in the mixing chamber increases, thereby <<upsetting>> the injector.

The third preferred option of embodiment of the suggested method involves transmission of the two-phase steam-liquid flow formed in the mixing chamber at a speed equal or exceeding the local sonic speed and subjection of said flow to shock wave.

The above features allow to create a more homogeneous and finer dispersed two-phase steam-liquid flow characterized by reduced local sonic speed (a). On the other hand, an increase in speed of the product flow at entry to the mixing chamber increases proportionally an absolute value of the two-phase steam-liquid flow speed. As a result, the Mach number $$M = \frac{W}{a},$$

i.e. ratio of the absolute flow speed (W) to the local sonic speed (a), increases. The shock wave intensity is in direct proportion to the square of the Mach number (See).

Another factor having impact on the shock wave intensity is β index.

$$\beta = \frac{Vst}{Vmix},$$

where Vst is volume of steam in the two-phase mixture and Vmix is volume of the two-phase mixture equal to a sum of volumes of steam and liquid contained in the mixture.

As indicated above, it is possible to regulate the intensity and degree of condensation of steam in the mixing chamber at the expense of the product flow speed. This provides another tool for regulating intensity of the shock wave through the β index over a wide range of injection indexes.

The fourth preferred option of embodiment of the suggested method involves forming at the injector outlet of regulated backpressure, thereby enabling regulation of intensity of the shock wave and its location in the channel of the injector. This feature in combination with the above method of β index regulation and with injection index held constant, provides for a new property giving an additional tool for regulating intensity of the shock wave.

The fifth preferred option of embodiment of the suggested method involves a partial heat and/or mass abstraction from the supersonic steam-liquid flow, allowing to increase speed and kinetic energy of the two-phase steam-liquid flow. This feature, in combination with those listed above, further improves operating characteristic of the injector and allows to regulate intensity of the shock wave.

The sixth preferred option of embodiment of the suggested method involves feeding the product to the mixing chamber in the form of a thin sheet with thickness within 0.15–2.5 mm. The thinner the product sheet contacting with steam in the mixing chamber, the better heat- and mass interchange between the product and steam.

This also improves turbulization of the flow and increases probability of the full contact between the product mass and steam and of shift flows between them. However, reducing the product sheet thickness below 0.15 mm would require an unjustified increase in product pressure at entry to the injector. In such cases the product is usually fed to the mixing chamber in <<cavitation condition>>, which is unacceptable. On the other hand, as experiments have demonstrated, increasing the product sheet thickness beyond 2.5 mm, leads to the loss of good properties provided by the present invention. Actual dimensions of the product sheet are determined on the basis of input and output parameters of the product (viscosity, flow rate, and temperature, on the one hand, and targeted dispersion and homogeneity levels, on the other hand).

The seventh preferred option of embodiment of the method of the invention (See FIG. 1) involves feeding steam to the mixing chamber only on one side of the product sheet, whereas the other side of the sheet is in contact with the wall of the injector channel. This option would be appropriate for low viscosity products on low capacity injectors with low injection index. It is distinguished by its mechanical simplicity.

The eighth preferred option of embodiment of the method of the invention (See FIG. 2) involves feeding steam to the mixing chamber on both sides of the product sheet. This option would be appropriate for high viscosity products on high capacity injectors. In such cases, contact area between the product and steam is at least twice as large, which eliminates slowing down of the product as a result of dragging against the walls in the forward part of the mixing chamber channel.

The ninth preferred option of embodiment of the suggested method (See FIG. 3) involves feeding the product through product nozzle placed along the injector axis, whereas steam is fed through a annular steam nozzle placed concentrically to the product nozzle. This design allows to process liquid products having solid particles (solid phase) dispersed in them (e.g. soups, pulps, salsa sauce, etc.) This version allows to homogenize liquid phase while providing the maximum preservation of the solid phase and heating of the whole product.

FIG. 1 schematically represents an axial section of the injector for embodiment of the seventh preferred option of the method of the invention.

Figure 2:
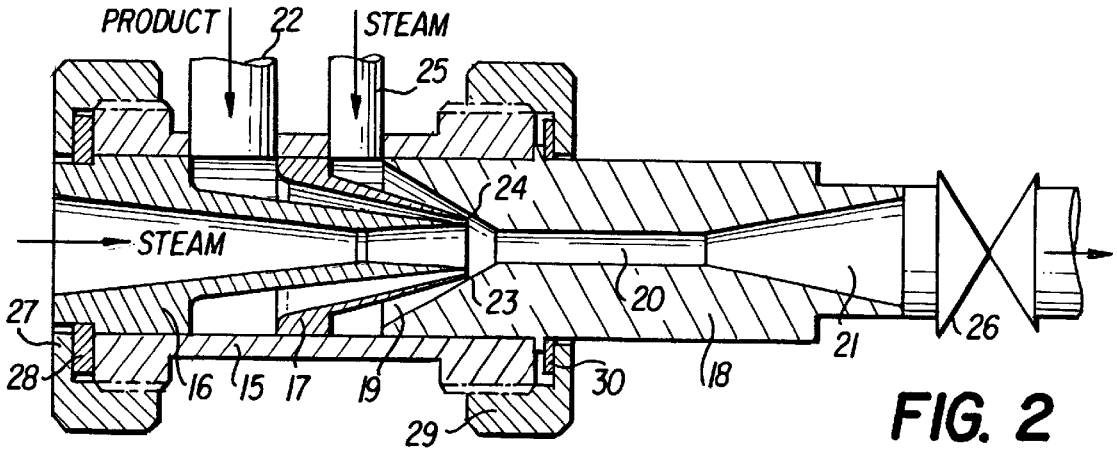

FIG. 2 schematically represents an axial section of the injector for embodiment of the eighth preferred option of the method of the invention.

Figure 3:
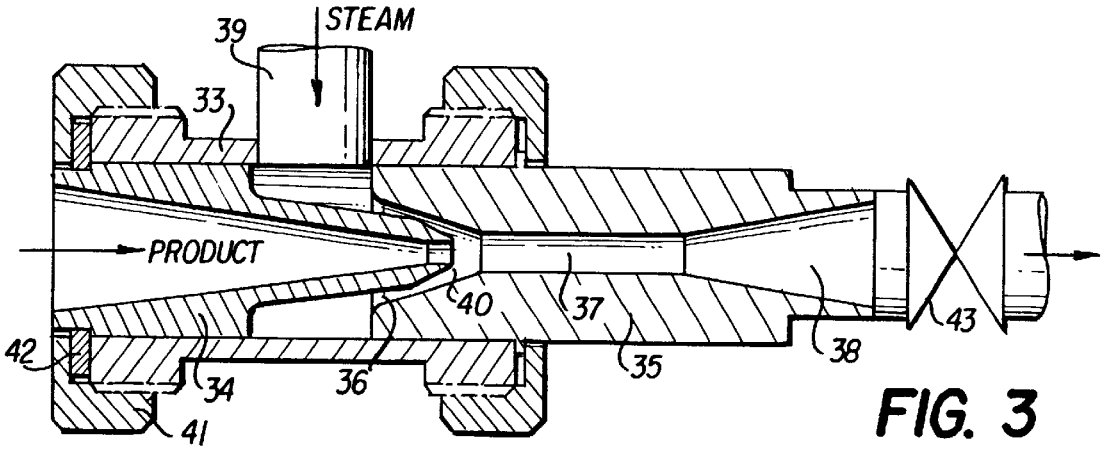

FIG. 3 schematically represents an axial section of the injector for embodiment of the ninth preferred option of the method of the invention.

Figure 4:
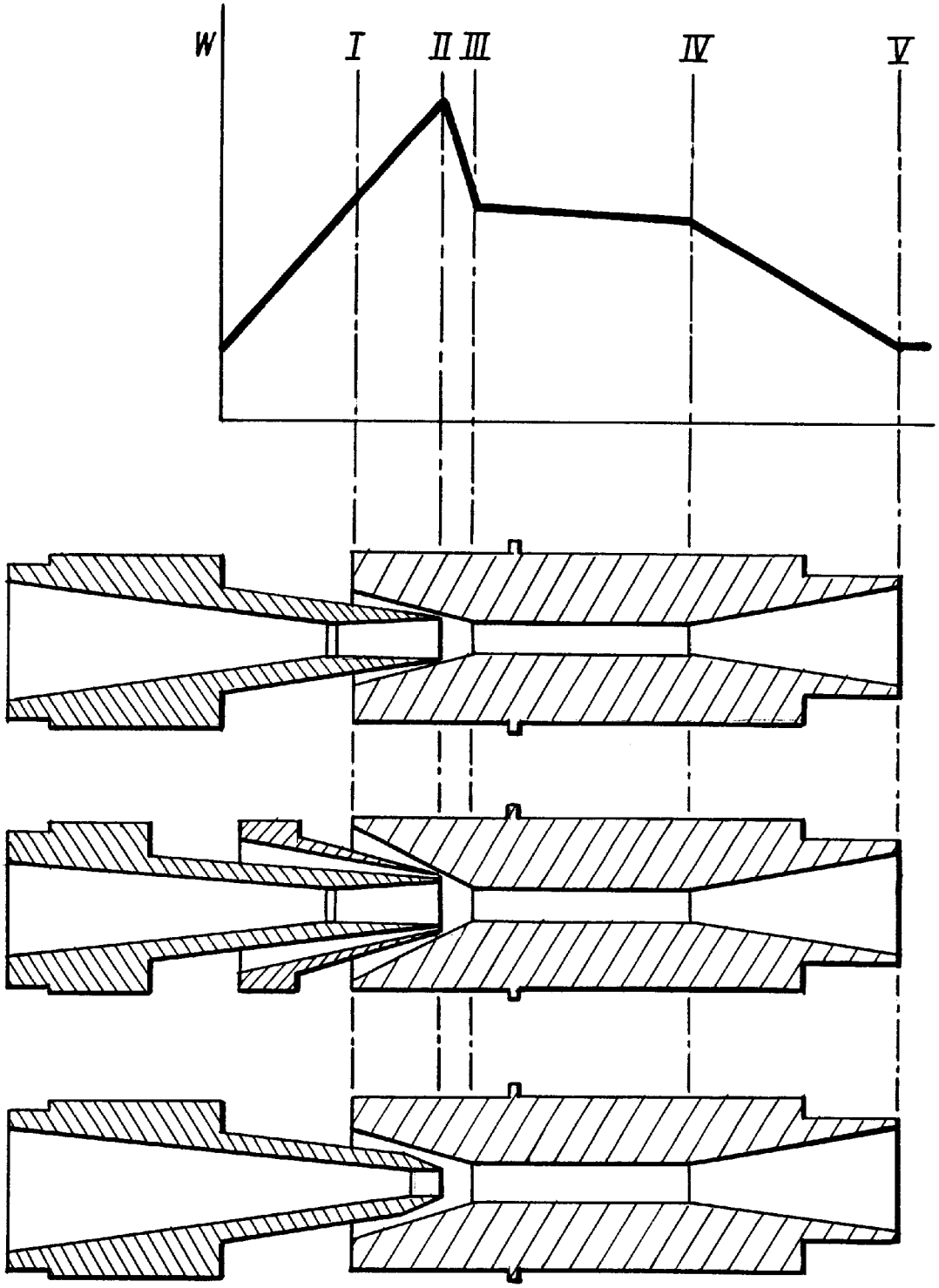

FIG. 4 schematically represents a speed curve along the injector channel before steam feeding.

Injector represented in FIG. 1 comprises body 1 enclosing steam nozzle 2, mixing chamber 3, comprising, as a rule, input snout (convergent tube) (4), cylindrical part 5 and diffuser 6. The product is fed to the injector through nipple 7. The product is fed to mixing chamber 3 through product nozzle 8 formed by the external wall of steam nozzle 2 and the internal wall of mixing chamber 3. Nozzle 2 represented in FIG. 1, is a supersonic steam nozzle which is used in most of the preferred options of embodiment of the method of the invention listed above. However, in the general case a subsonic steam nozzle may also be used.

At the output of the injector, a tap 9 is placed for regulating the intensity and location of shock wave in the mixing chamber. The thickness of the product sheet fed to mixing chamber 3 is determined by critical section area of nozzle 8 which is regulated by adjusting nut 10 and/or spacer 11.

Injector represented in FIG. 2 comprises body 15 enclosing internal steam nozzle 16, shaped separating cartridge 17, mixing chamber 18 comprising, as a rule, input snout (convergent tube) 19, cylindrical part 20 and diffuser 21. The product is fed to the injector through nipple 22. The product is fed to the mixing chamber 18 through product nozzle 23 formed by the external wall of nozzle 16 and the internal wall of separating cartridge 17. This version of the injector includes external (regarding the product sheet) steam nozzle 24, formed by the external wall of cartridge 17 and the internal wall of mixing chamber 18. Steam to external steam nozzle 24 is fed through nipple 25. In device represented in FIG. 2 both steam nozzles, 16 and 24, are supersonic which is not obligatory in the general case.

At the output of the injector, tap 26 is placed for regulating the intensity and location of shock wave in mixing chamber 18. The thickness of the product sheet fed to mixing chamber 18 is determined by critical section area of nozzle 23 which is regulated by adjusting nut 27 and/or spacer 28. This version of the injector allows to regulate critical section area of external steam nozzle 24 by adjusting nut 29 and/or spacer 30.

Injector represented in FIG. 3 comprises body 33 enclosing product nozzle 34, mixing chamber 35 comprising as a rule, input snout (convergent tube) 36, cylindrical part 37 and diffuser 38. Steam is fed to the injector through nipple 39, then to mixing chamber 35 through steam nozzle 40. Steam nozzle 40 is formed by the external wall of nozzle 34 and the internal wall of separating cartridge 17. This version of the injector includes external (regarding the product sheet) steam nozzle 24, formed by the external wall of cartridge 17 and an internal wall of mixing chamber 18. Steam to external steam nozzle 24 is fed through nipple 25. In device represented in FIG. 2 both steam nozzles, 16 and 24, are supersonic which is not obligatory in the general case. Critical section area of nozzle 8 may be regulated by adjusting nut 41 and/or spacer 42. At the output of the injector, tap 43 is placed for regulating the intensity and location of shock wave in mixing chamber 35.

FIG. 4 represents the product speed curve W at different characteristic parts of the injector channel before steam feeding. This curve is practically identical for all three embodiments listed above (FIG. 1–3). Therefore, it relates to all three of them simultaneously. Characteristic sections are marked with Roman numerals as follows:

I. input section of the product nozzle;

II. output (critical) section of the product nozzle, which coincides with section of product entry into the mixing chamber;

III. output section of the input snout part of the mixing chamber which coincides with the head of its cylindrical part;

IV. output section of the cylindrical part of the mixing chamber which coincides with its diffuser part;

V. output section of the diffuser part of the mixing chamber which coincides with the head of the product output conduit.

Injector represented in FIG. 1 operates as follows:

Product is fed through nipple 7 and product nozzle 8 to mixing chamber 3 of the injector. Speed of the product flow at section 11 (See FIG. 4) is determined according to targeted quality parameters of the product (homogeneity, dispersion rate, sterility, etc.) and to its input parameters (temperature, viscosity, flow rate, etc.).

By means of adjusting nut 10 and/spacer 11, the appropriate size of the product nozzle critical section is set which determines the thickness of product sheet to be fed to mixing chamber 3. According to the present invention, maximum speed of the product flow and, correspondingly, minimum static pressure before steam feeding occur at output section of product nozzle 8. Therefore, the injector becomes <<(compensated)>> up to creation of vacuum in steam nozzle 2. This makes starting up easier and allows to make the process automatic. Steam is fed to the injector through nozzle 2. The above mode of operation insures stable performance of the injector, even when working with recuperated steam at pressure equal to –0.4 Bar (relative vacuum). Steam is mixed with product, thereby forming a two-phase steam-liquid mixture. Speed and level of steam condensation in the product depends not on only on temperature difference but on condensation conditions as well (turbulization of the flow, heat-exchange surface, dimension of condensation, etc.). The invention, depending on a stated aim, allows to achieve two diametrically opposed effects. On the one hand, by means of increase in speed and reduction of thickness of the product sheet at the mixing chamber input, increase in heat-exchange surface and turbulization of the flow is achieved leading to intensification of mixing and heat-and-mass exchange between steam and the product.

This allows to increase the injector capacity and amount of product heating and extend the injection index range on he minimum side. On the other hand, when the flow speed is such that the product fed to the mixing chamber is on the verge of boiling, the speed and intensity of heat exchange decrease and incoming steam is used for producing a finely dispersed homogeneous two-phase steam-liquid mixture as described in more detail above. This makes it possible, even at a high injection index (U=100 and above), to form a supersonic two-phase steam-liquid flow with a subsequent shock wave, which, as is well known, allows to improve the quality of the product. Intensity and location of the shock wave in the injector channel is regulated by tap 9 placed at the output flow conduit. According to theory, the Mach number, as indicated above, is $$M = \frac{W}{a}$$

According to the method of the invention, speed W of the two-phase steam-liquid mixture increases whereas sonic speed $\alpha$ in this medium drops. This allows to regulate the intensity of the shock wave (which varies as the square of Mach number) in a wider range, as compared to the prior art methods. The speed of the two-phase steam-liquid mixture increases as kinetic energy of the steam flow. Injector represented in FIG. 2 operates in much the same way as injector according to FIG. 1. The main distinction is the external steam nozzle 24 with regulated critical section area which makes it possible to regulate the rate of the steam flow through the nozzle. Due to this feature, contact area between the product and steam is at least doubled, thereby eliminating slowing down of the product caused by dragging against the walls in the forward part of the mixing chamber channel 18. This feature is of particular interest in case of processing high viscosity products and in high capacity injectors.

Injector represented in FIG. 2 operates in the following manner: the product is fed to mixing chamber 35 through product nozzle 34 while steam is fed through a steam nozzle placed concentrically to product nozzle 40. This design allows to process liquid products having solid particles (solid phase) dispersed in them. Homogenizing involves mainly liquid phase, thereby providing maximum preservation of the solid phase while heating the whole product.

Injector designs represented in FIGS. 1–3 are examples rather than only possible versions of embodiment of the suggested method.

Although only preferred embodiments are specifically illustrated and described herein, it will be appreciated that many modifications and variations of the present invention are possible in light of the above teachings and within the purview of the appended claims without department from the spirit and intended scope of the invention.

What is claimed:

1. A method of heating and/or homogenizing products in a steam-liquid injector comprising the steps of:

a) feeding steam and liquid product into a mixing chamber—through a steam nozzle and a product nozzle accordingly; accelerating a product at entry to the mixing chamber to a maximum permissible speed matching processing operating conditions, while not exceeding the speed at which the static pressure of the flow matches the saturation pressure at an input temperature of the product, the maximum speed according to the liquid flow speed curve in the injector channel before steam feeding, being observed at the output cross-sectional area of the product nozzle;

b) forming in the mixing chamber a two-phase steam-liquid flow by mixing the product with steam; and c) compressing the two-phase steam-liquid flow and condensing steam in the product.

2. A method according to claim 1, wherein the feeding speed is equal to or exceeds the sonic speed.

3. A method according to claim 1 or claim 2, wherein steam is fed to the mixing chamber at a speed corresponding to the temperature of the product equal to or lower than its final heating temperature, but remaining above input temperature of the product.

4. A method according to claim 3 wherein a preferred temperature is calculated by the following formula:

$$Tst = Tin + \frac{Tout - Tin}{2},$$

where

Tst is steam temperature at the mixing chamber inlet,

Tin is product temperature at the injector inlet, and

Tout is final product heating temperature.

5. A method according to claim 1, comprising the step of transmission of a two-phase steam-liquid flow formed in the mixing chamber at a speed equal to or exceeding the local sonic speed for this mixture, thereby creating conditions for shock wave, compression and condensation.

6. A method according to claim 5, comprising the step of creation at the injector outlet of regulated backpressure, thereby enabling regulation of intensity and location of the shock wave in the channel of the injector.

7. A method according to claim 5, comprising at least one step of a partial heat or a mass abstraction from a sonic or supersonic two-phase steam-liquid flow.

8. A method according to claim 1, wherein product is fed to the mixing chamber in the form of a thin sheet with thickness falling within 0.15–2.5 mm.

9. A method according to claim 8, wherein steam is fed to the mixing chamber only on one side of said sheet of product.

10. A method according to claim 8 wherein steam is fed to the mixing chamber on both sides of said sheet of product.

11. A method according to claim 1, wherein product is fed to the mixing chamber through a product nozzle placed along the injector axis, whereas steam is fed through a annular steam nozzle placed concentrically to the product nozzle.

12. A method according to claim 11 whereby the product nozzle is formed by the external wall of the product nozzle and the internal wall of the mixing chamber.

* * * * *